US008272897B1

(12) United States Patent
Lin

(10) Patent No.: US 8,272,897 B1
(45) Date of Patent: Sep. 25, 2012

(54) ELECTRICAL CONNECTOR

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/211,260

(22) Filed: Aug. 16, 2011

(51) Int. Cl.
*H01R 13/648* (2006.01)

(52) U.S. Cl. ..... 439/607.4

(58) Field of Classification Search ..... 439/607.4, 439/607.35, 607.36, 607.37, 607.38, 607.39, 439/79
See application file for complete search history.

(56) References Cited

U.S. PATENT DOCUMENTS 4,717,218 A * 1/1988 Ratcliff ..... 439/59
4,997,996 A * 3/1991 Ohashi ..... 174/260
5,035,641 A * 7/1991 Van-Santbrink et al. ..... 439/329
5,989,040 A * 11/1999 Nishimatsu ..... 439/79
6,062,911 A * 5/2000 Davis et al. ..... 439/630
6,095,865 A * 8/2000 Wu ..... 439/607.01
6,109,966 A * 8/2000 Chiou ..... 439/607.03
6,129,562 A * 10/2000 Hong ..... 439/79
6,315,620 B1 * 11/2001 Moir et al. ..... 439/862
6,398,578 B1 * 6/2002 Huang ..... 439/369
7,081,011 B2 * 7/2006 Kikuchi et al. ..... 439/541.5
7,182,610 B2 * 2/2007 Lin ..... 439/79
7,217,159 B2 * 5/2007 Chung ..... 439/607.01
7,458,826 B1 * 12/2008 Maatta ..... 439/79
7,680,150 B2 * 3/2010 Liu et al. ..... 370/469
7,883,369 B1 * 2/2011 Sun et al. ..... 439/607.35
8,142,225 B2 * 3/2012 Yu ..... 439/607.35
2003/0207600 A1 * 11/2003 Ho ..... 439/79

* cited by examiner

*Primary Examiner* — Phuong Dinh
(74) *Attorney, Agent, or Firm* — Cheng-Ju Chiang

(57) ABSTRACT

The present invention discloses an electrical connector that is soldered on a circuit board. The circuit board has an opening recess having a hooking recess extending forward and outward and formed at each of two side edges of the opening recess. Two side walls of shell of the electrical connector are punched to form flexible fixing pieces, which extend forward and outward, respectively. A track groove is formed in front or rear of the flexible fixing piece in each of the two side walls of the shell. The circuit board can be inserted into the track grooves, and the flexible fixing pieces can be flexibly held in the hooking recesses. The present invention can economize spaces at both sides as well as reduce volume of the electrical connector by engaging the flexible fixing pieces and the hooking recesses, and engaging the track grooves and the circuit board.

4 Claims, 4 Drawing Sheets

ELECTRICAL CONNECTOR

BACKGROUND OF THE INVENTION

1. Field of the Invention

The present invention relates to a connector, and more particularly to an electrical connector with a reduced volume.

2. Description of the Prior Art

As shown in FIG. 1, an electrical connector 100' of prior art is soldered on a circuit board 200'. The electrical connector 100' includes an insulating body 10', a plurality of terminals (not shown in the figure) accommodated in the insulating body 10', and a shell 20'. Two side walls of a bottom wall of the shell 20' are disposed with a plurality of welding portions 21' and a plurality of welding legs 22' extending outwardly. The circuit board 200' is arranged with an opening recess 201'. The circuit board 200' has a welding hole 202' in rear of the opening recess 201' on each of the two sides. The welding portions 21' are soldered on the top surface of the circuit board 200', and the welding legs 22' are soldered into the welding holes 202'.

However, the welding portions 21' and the welding legs 22' of the electrical connector 100' and the circuit board 200' are combined to form a composite structure which occupies an increased side space at both sides of the electrical connector 100', and this also increases the volume of the electrical connector 100'.

BRIEF SUMMARY OF THE INVENTION

An object of the present invention is to provide an electrical connector which can economize spaces at both sides as well as reduce volume of an electrical connector so as to overcome the shortage in the prior art.

To achieve the above object, in accordance with the present invention, an electrical connector which is soldered on a circuit board is provided. The circuit board has an opening recess, and the opening recess has a hooking recess extending forward and outward formed at each of two side edges. The electrical connector further includes an insulating body, a plurality of terminals, and a shell. The insulating body has a plurality of terminal slots. The terminals are placed in the terminal slots of the insulating body. The shell covers the insulating body. Two side walls of the shell are punched to form flexible fixing pieces, which extend forward and outward, respectively. A track groove is formed in front or rear of the flexible fixing piece in each of the two side walls of the shell. The circuit board can be inserted into the track grooves, and the flexible fixing pieces can be flexibly held in the hooking recesses.

As mentioned above, the electrical connector of the present invention by engaging the flexible fixing pieces and the hooking recesses, as well as engaging the track grooves and the circuit board, so that the electrical connector is tightly engaged with the circuit board in the up, down, front and rear directions. That is, by structurally designing the flexible fixing pieces and the track grooves, the electrical connector can economize spaces at both sides, and volume of the electrical connector is reduced as well.

DETAILED DESCRIPTION OF THE PREFERRED EMBODIMENTS

To describe the technical matters, structural features, achieved objects and effects, an embodiment is described in detail with reference to the accompanying drawings as follows.

Figure 1:
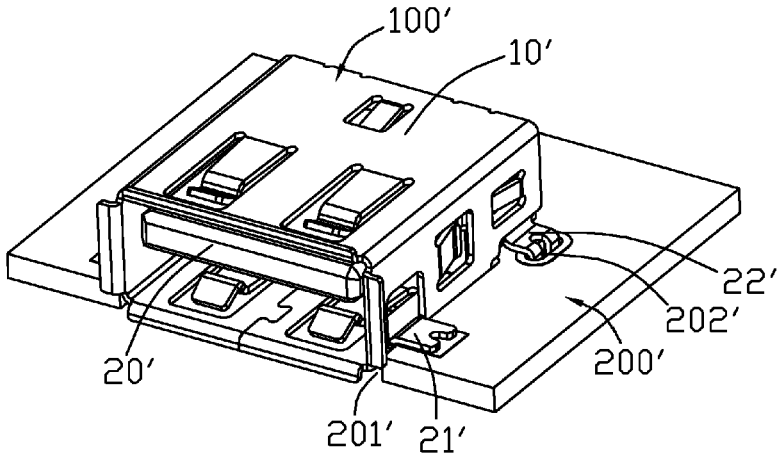
FIG. 1 (Prior Art)
FIG. 1 is a perspective view of an electrical connector assembly of prior art.
Figure 2:
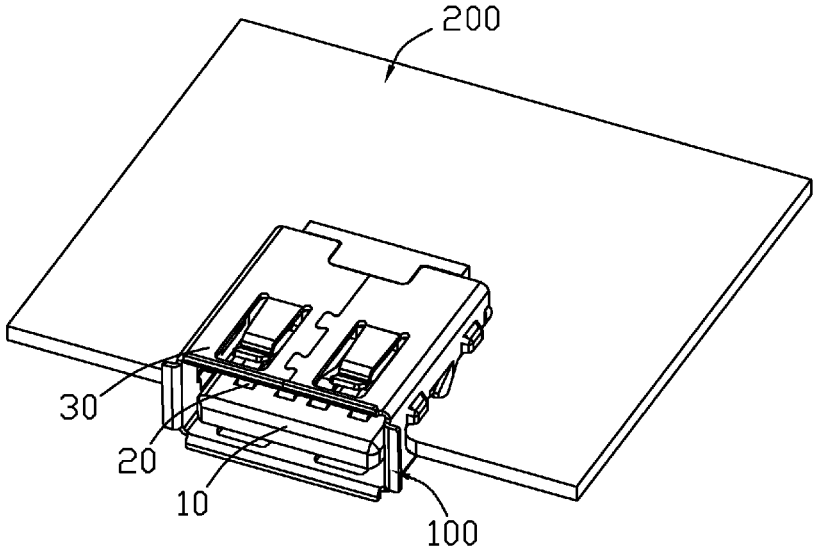
FIG. 2 is a perspective view of an electrical connector assembly according to the present invention.
Figure 3:
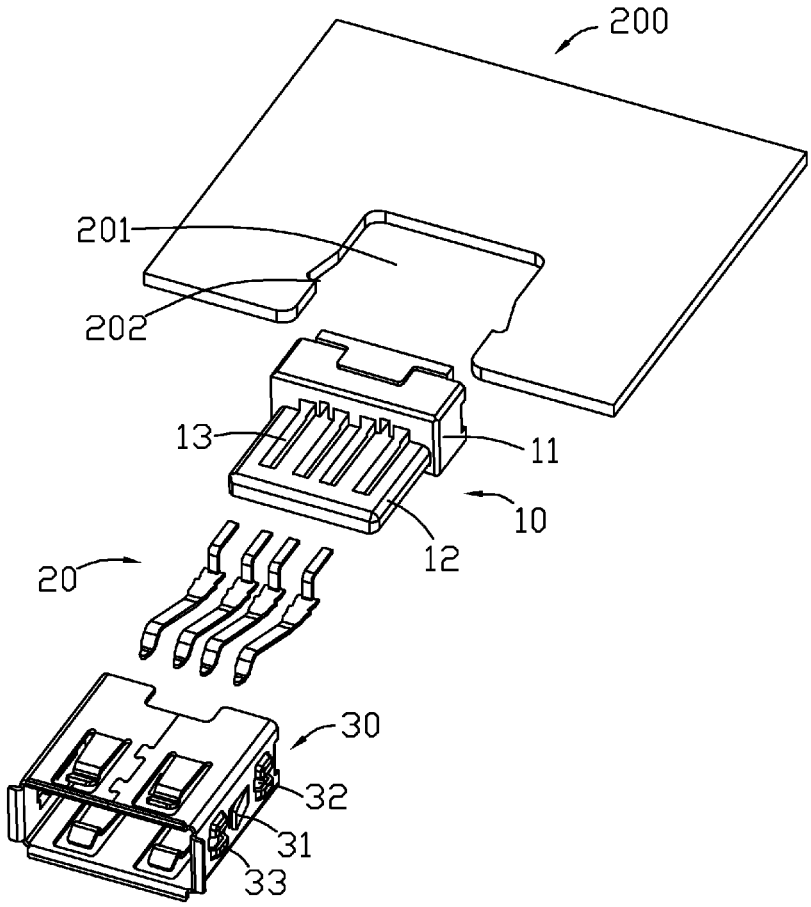
FIG. 3 is an exploded perspective view of the electrical connector assembly of FIG. 2.

Please refer to FIGS. 2 and 3, an electrical connector 100 of the present invention is soldered on a circuit board 200. The electrical connector 100 further has an insulating body 10, a plurality of terminals 20 accommodated in the insulating body 10, and a shell 30. The circuit board 200 has an opening recess 201, and the opening recess has a hooking recess 202 extending forward and outward formed at each of two side edges.

Figure 4:
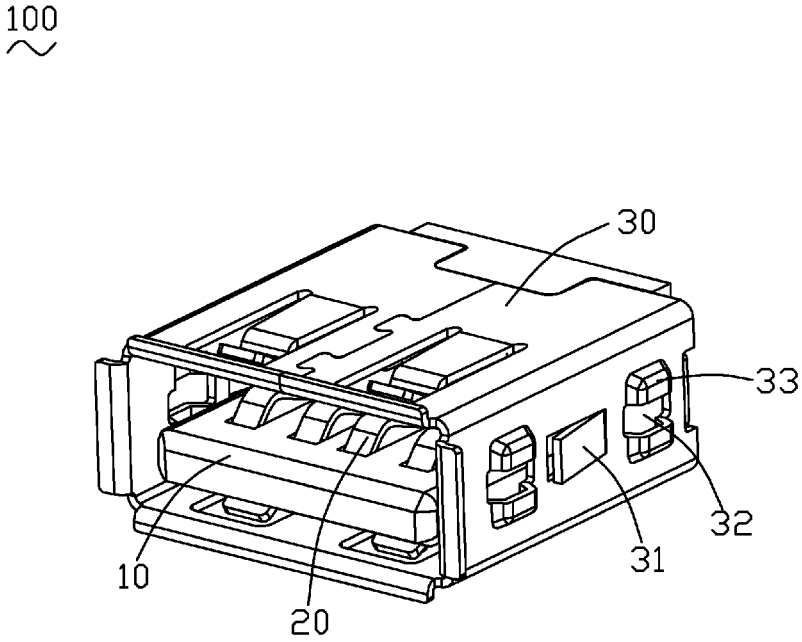
FIG. 4 is a perspective view of the electrical connector of FIG. 2.

Please refer to FIGS. 2 to 4, the insulating body 10 has a base portion 11, and a tongue portion 12 extending forward from a front end of the base portion 11. A plurality of terminal slots 13 are placed on the tongue portion 12, and extend to the base portion 11.

The terminals 20 are placed in the terminal slots 13 of the insulating body 10.

The shell 30 covers the insulating body 10. Two side walls of the shell 30 are punched to form flexible fixing pieces 31, which extend forward and outward, respectively. A track groove 32 penetrates through the two side walls of the shell 30, and the shell 30 having flexible fixing piece 31 formed in front or rear of each of the two side walls thereof. The circuit board 200 can be inserted into the track grooves 32, and the flexible fixing pieces 31 can be flexibly held in the hooking recesses 202. Preferably, each of the two side walls of the shell 30 has two tabs 33 arranged up and down in front and rear of the flexible fixing piece 31, respectively, and the track grooves 32 is defined between the two tabs 33, and the track grooves 32 penetrating through the two side walls of the shell 30.

When the electrical connector 100 of the present invention is assembled, the terminals 20 are firstly placed in the terminal slots 13 of the insulating body 10, and then the shell 30 is bent to cover the insulating body 10, thus completing the assembling process.

When the electrical connector 100 of the present invention is assembled on the circuit board 200, the circuit board 200 aligns with the track grooves 32 and is inserted into the track grooves 32 of the electrical connector 100, whereby each of the two sides of the flexible fixing pieces 31 of the electrical connector 100 are firstly pressed with the each of two side edges of the opening recess 201 of the circuit board 200. The flexible fixing pieces 31 are flexibly expanded and held in place of the hooking recesses 202 until the flexible fixing pieces 31 is stuck into the hooking recess 202, thus completing the assembling process of the electrical connector 100. The electrical connector 100 is tightly engaged with the circuit board 200 in the up, down, front and rear directions by the flexible fixing pieces 31 engaging the hooking recesses 202, as well as the track grooves 32 engaging the circuit board 200.

As mentioned above, the electrical connector 100 of the present invention by engaging the flexible fixing pieces 31 and the hooking recesses 202, as well as engaging the track grooves 32 and the circuit board 200, by structurally designing the flexible fixing pieces 31 and the track grooves 32 can economize spaces at both sides as well as reduce volume of the electrical connector 100, so that the electrical connector 100 is tightly engaged with the circuit board 200 in the up, down, front and rear directions.

It should be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, soldered on a circuit board, the circuit board having an opening recess, which is arranged with a hooking recess extending forward and outward and formed at each of two side edges thereof, the electrical connector further comprising:

an insulating body having a plurality of terminal slots;

a plurality of terminals being placed in the terminal slots of the insulating body; and a shell covering the insulating body, the shell having two side walls being punched to form flexible fixing pieces extending forward and outward, respectively, a track groove being formed in front or rear of the flexible fixing piece in each of the two side walls of the shell, and the circuit board being able to be inserted into the track grooves, and the flexible fixing pieces being able to be flexibly held in the hooking recesses.

2. The electrical connector of claim 1, wherein each of the two side walls of the shell has two tabs arranged up and down in front and rear of the flexible fixing piece, respectively, and the track groove is defined between the two tabs.

3. The electrical connector of claim 2, wherein the track grooves penetrate through the two side walls of the shell.

4. The electrical connector of claim 1, wherein the track grooves penetrate through the two side walls of the shell.

* * * * *